US007422319B2

(12) United States Patent
Saito et al.

(10) Patent No.: US 7,422,319 B2
(45) Date of Patent: Sep. 9, 2008

(54) PAPER DISCHARGER AND INK JET RECORDING APPARATUS INCORPORATING THE SAME

(75) Inventors: Kazuo Saito, Nagano (JP); Hideyuki Kataoka, Nagano (JP); Seiji Kawabata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/354,148

(22) Filed: Jan. 30, 2003

(65) Prior Publication Data

US 2003/0179272 A1 Sep. 25, 2003

(30) Foreign Application Priority Data

Jan. 31, 2002 (JP) ..... P2002-024088
Jan. 28, 2003 (JP) ..... P2003-019364

(51) Int. Cl.
*B41J 13/03* (2006.01)
*B41J 2/01* (2006.01)
*B14J 13/00* (2006.01)
*B65H 15/00* (2006.01)

(52) U.S. Cl. ..... 347/104; 400/624; 400/625; 400/629

(58) Field of Classification Search ..... 400/642, 400/624, 625; 347/108, 104; 271/65, 66
See application file for complete search history.

(56) References Cited

U.S. PATENT DOCUMENTS 4,774,523 A * 9/1988 Beaufort et al. ..... 346/25
5,005,025 A * 4/1991 Miyakawa et al. ..... 346/25
5,026,184 A * 6/1991 Durr et al. ..... 400/605
5,553,528 A * 9/1996 Zoltner ..... 83/443
5,586,758 A 12/1996 Kimura et al.
5,764,245 A * 6/1998 Yokoi ..... 347/16
6,132,038 A * 10/2000 Szlucha ..... 347/102

(Continued)

FOREIGN PATENT DOCUMENTS

CN 1220211 A 6/1999

(Continued)

OTHER PUBLICATIONS

Machine translation of JP 07323615 A to Fukazawa from Japanese Patent Office website.*

(Continued)

*Primary Examiner*—Daniel J. Colilla
(74) *Attorney, Agent, or Firm*—Sughrue Mion, PLLC

(57) ABSTRACT

[Object] To discharge printed paper to a different position on a single discharge tray by providing a changing means for changing a discharge direction of paper conveyed and discharged from a paper discharge part.

[Solving Means]

A page printer 10 including a paper discharge part for conveying and discharging printed paper 1 onto a discharge tray 11 is provided with an auxiliary roller 23*b* which is positioned near the outlet of the paper discharge part and guides the paper 1 on its bottom side, and a roller driving part 30 which is brought into sliding contact with or separated from the paper 1 by moving the auxiliary roller 23*b* so as to be advanced or retreated to/from the bottom surface of the paper 1, so that the discharge positions of the paper 1 on the discharge tray 11 are made different from each other alternately for each printed data.

14 Claims, 7 Drawing Sheets

U.S. PATENT DOCUMENTS

| | | | | |
|---|---|---|---|---|
| 6,183,152 | B1 * | 2/2001 | Kumai et al. | 400/611 |
| 6,412,916 | B1 * | 7/2002 | Okano et al. | 347/55 |
| 6,415,118 | B1 * | 7/2002 | Setoriyama et al. | 399/92 |
| 6,424,364 | B2 * | 7/2002 | Gundlach et al. | 347/111 |
| 6,457,888 | B1 * | 10/2002 | Matsumoto | 400/625 |
| 6,659,603 | B2 | 12/2003 | Kida et al. | |
| 2001/0028381 | A1 | 10/2001 | Kashiwagi et al. | |
| 2001/0033764 | A1 | 10/2001 | Kimura et al. | |
| 2002/0006300 | A1 * | 1/2002 | Kawaguchi | 400/118.2 |
| 2002/0089559 | A1 * | 7/2002 | Drake | 347/15 |
| 2003/0025777 | A1 * | 2/2003 | Sugiyama | 347/104 |

FOREIGN PATENT DOCUMENTS

| | | | | |
|---|---|---|---|---|
| EP | 0 764 543 | A1 | | 3/1997 |
| JP | 07323615 | A | * | 12/1995 |
| JP | 09277648 | A | * | 10/1997 |
| JP | 10-109447 | A | | 4/1998 |
| JP | 11-20252 | A | | 1/1999 |
| JP | 11157757 | A | * | 6/1999 |
| JP | 11198470 | A | * | 7/1999 |
| JP | 11334979 | A | * | 12/1999 |
| JP | 2000-31288 | A | | 1/2000 |
| JP | 2000-71532 | | | 3/2000 |
| JP | 2001-31288 | A | | 2/2001 |
| JP | 2001-191513 | A | | 7/2001 |
| JP | 2001199599 | A | * | 7/2001 |
| JP | 2001-301151 | A | | 10/2001 |

OTHER PUBLICATIONS

Machine translation of JP 11-334979 to Saito from Japanese Patent Office website.*

Machine translation of JP 9-277648 to Shimada from Japanese Patent Office website.*

* cited by examiner

PAPER DISCHARGER AND INK JET RECORDING APPARATUS INCORPORATING THE SAME

BACKGROUND OF THE INVENTION

The present invention relates to an ink jet recording apparatus comprising a recording section at which a recording head is reciprocated in a main scanning direction while ejecting ink therefrom to execute recording over a fed recording paper, and a transporter for intermittently transporting the recording paper in a subscanning direction, and a paper discharger provided in the ink jet recording apparatus.

In such an ink jet recording apparatus, a phenomenon which is generally referred to as a so-called cockling phenomenon is generated by the water content of ink discharged onto the recording surface of the recording sheet so that the recording paper is corrugated in the main scanning direction. Although the corrugation of the recording paper which is generated by the cockling phenomenon has already been regulated to have a wave in a small cycle of approximately 10 mm to 25 mm, thereby preventing a great corrugation (for example, disclosed in Japanese Patent Publication No. 2000-71532A), there has not been found an ink jet recording apparatus which is able to reduce the corrugation itself.

Moreover, since a recording paper referred to as a so-called plain paper does not have a high rigidity differently from a special sheet preferably used for performing photograph-like recording which realizes advanced picture quality, there is generated a phenomenon in which the recording paper is curled through the step of once moistening the recording surface of the recording paper by the water content of the ink discharged onto the same recording surface and then drying the same recording surface. The curl becomes more remarkable if the amount of the ink discharged onto one recording paper is larger, that is, an ink duty is increased.

In a state where the ink landed onto the recording paper is dried, both sides are curled to surround the recording surface inwardly in most cases. The degree of the curl is varied depending on the firmness of the paper, that is, the rigidity or the ink duty in printing. In some cases in which the degree of the curl is the greatest, the recording paper is curled cylindrically.

Therefore, in the case where the recording paper obtained after the execution of the recording has the corrugation caused by the cockling phenomenon, conventionally, the corrugation is manually corrected to be reduced, for example, the recording paper is interposed between flat plates to apply a load, or the corrugation is left as it is.

In the case where the recording paper is curled cylindrically, a user is obliged to correct the curl. In addition, in the case where the user corrects the recording paper curled cylindrically, the recording paper is forcibly curled manually in a reverse direction to the direction of the curl. Consequently, an irregular wrinkle or a locally small curved portion is newly generated. Even if the curl can be mended to some degree, the uniform flatness of the whole recording paper cannot be obtained, that is, the recording paper itself is damaged. Thus, there is a problem in that the quality of a printed matter is deteriorated.

SUMMARY OF THE INVENTION

It is therefore an object of the invention to provide a paper discharger capable of carrying out a correction to reduce a corrugation itself caused by a cockling phenomenon, and furthermore, mending a curl generated on a recording paper and rarely damaging the recording paper in the mending, and an ink jet recording apparatus paper incorporating such a paper discharger.

In order to achieve the above object, according to the invention, there is provided an ink jet recording apparatus, comprising:

a recording section, in which a recording head is reciprocated in a first direction while ejecting ink therefrom onto a recording medium;

a transporter, operable to transport the recording medium in a second direction perpendicular to the first direction; and a discharger, including a curving path in which a transporting direction of the recording medium is inversed such that a first face of the recording medium on which recording has been performed faces inward.

In such a configuration, the recording medium which is moistened by the ink and is then being dried, that is, the recording medium which is being corrugated is curved in the curving path so that corrective force in a direction orthogonal to the curving direction can be caused to act on the recording medium. Consequently, the corrective force directed in the first direction acts on the recording medium. Accordingly, the corrugation in the first direction of the recording medium which is generated by a cockling phenomenon can be corrected and reduced by the curving path.

In some cases, the recording medium is curled cylindrically due to a moisture caused by the water content of the ink and a subsequent dryness. According to the above configuration, the recording medium is caused to pass through the curving path and is thereby curved in the direction orthogonal to the curling direction. Consequently, it is possible to automatically and easily mend the curl generated on the recording medium without bothering a user. In addition, the recording medium is rarely damaged in the mending. Thus, it is also possible to prevent the quality of a printed matter from being deteriorated.

Furthermore, it is possible to constitute the ink jet recording apparatus in which the recording medium fed from the front side of an ink jet recording apparatus is discharged to the front side again after the execution of the recording.

Preferably, it is preferable that: at least one pair of a drive roller and a driven roller is disposed in the curving path such that the recording medium is held and transported therebetween; and the driven roller is brought into contact with the first face of the recording medium.

In such a configuration, it is possible to reduce a possibility that the discharging drive roller might slip from a surface coming in contact with the recording medium so that the delivery state of the recording medium might become unstable, and thereby securing the function of correcting cockling and mending a curl.

It is incidentally preferable that the driven roller arranged closest to a termination end of the curving path, has teeth formed on an outer periphery thereof.

In such a configuration, when the recording medium is discharged from the curving path, it is pushed out in the discharge direction in such a state that the groove of the toothed roller (a portion between teeth) is caught in a trailing end of the recording medium. Consequently, it is possible to reliably discharge the recording medium from the curving path.

It is also incidentally preferable that a transporting path defined in the recording section is upwardly inclined toward the discharger.

The force for correcting the corrugation which acts on the recording medium in the curving path also acts on the corrugated portion of the recording paper which still situates in the recording section. Accordingly, if the curvature of the curving path is too large, that is, the curvature radius of the curving path is small, the corrective force is too great so that the recording medium in the recording section might float. For this reason, there is a possibility that a part of the recording medium in the recording section might float to come in contact with the recording head.

According to the above configuration, it is possible to delivery the recording medium to the curving path with a relatively smaller curvature. Therefore, it is possible to reduce a possibility that the curvature of the transporting path might be increased excessively, resulting in the float of the recording medium in the recording section by the corrective force of the curving path.

Here, it is preferable that an inclined angle of the transporting path in the recording section is within a range of 30 degrees to 75 degrees.

In such a configuration, the effect of preventing the float of the recording medium can be obtained more reliably.

Preferably, an outlet of the curving path is configured such that the recording medium is almost horizontally discharged therefrom.

In such a configuration, the operability of the apparatus can be enhanced.

Preferably, the recording section includes a platen defining a spacing between a head face of the recording head and the first surface of the recording medium. A plurality of ribs are formed on the platen so as to extend in the second direction.

Here, it is preferable that the ribs are formed on the platen so as to avoid portions at which both side end portions of the recording medium are brought into contact.

As described above, the force for correcting the corrugation which acts on the recording medium in the curving path also acts on the corrugated portion of the recording paper which still situates in the recording section. Consequently, there is a possibility that the recording medium might float by the corrective force. In that case, the recording medium is apt to float at both side ends thereof by the corrective force of the curving path.

According to the above configurations, the height of both side ends of the recording medium in the recording section is accordingly reduced. Therefore, when the recording medium is corrugated by the cockling phenomenon, the float of the recording medium caused by the corrugation in the vicinity of both side ends of the recording paper can be reduced.

Consequently, it is possible to reduce a possibility that both side ends of the recording medium in the recording section floated by the corrective force of the curving path might come in contact with the recording head.

According to the invention, there is also provided a discharger, incorporated in an ink jet recording apparatus to discharge a recording medium which has been subjected to recoding operation to an exterior portion of the ink jet recording apparatus, the discharger comprising a curving path in which a transporting direction of the recording medium is inversed such that a first face of the recording medium on which recording has been performed faces inward.

Preferably, the discharger further comprises at least one pair of a drive roller and a driven roller disposed in the curving path such that the recording medium is held and transported therebetween. The driven roller is brought into contact with the first face of the recording medium.

Here, it is preferable that the driven roller arranged closest to a termination end of the curving path, has teeth formed on an outer periphery thereof.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
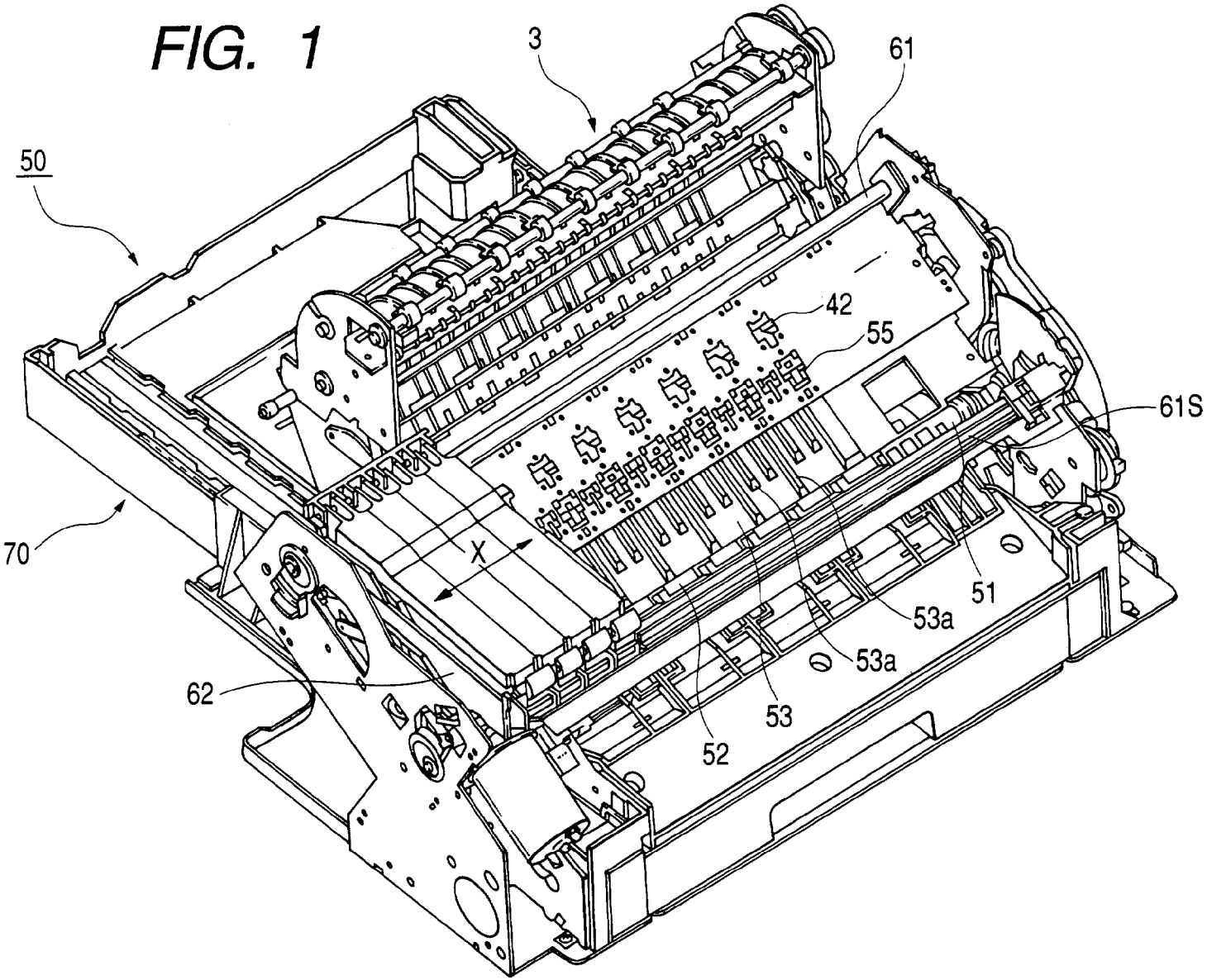
FIG. 1 is a perspective view of an ink jet recording apparatus according to an embodiment of the invention.

A preferred embodiment of the invention will be described below with reference to the accompanying drawings.

An ink jet recording apparatus 50 is provided with a recording section 66 in which a carriage 62 is pivotally supported on a carriage guide shaft 61 and a sub guide shaft 61S and is reciprocated in a main scanning direction X orthogonal to a recording paper delivery direction (subscanning direction), while ejecting ink from a recording head 63 onto a recording surface a recording sheet P. The recording head 63 is mounted on the carriage 62.

A platen 53 for defining a spacing between a head face of the recording head 63 and the recording sheet P is provided opposite to the recording head 63. A plurality of ribs 53*a* are provided on the platen 53 corresponding to a cycle between the corrugations of the recording sheet P which are generated by a cockling phenomenon, and serve to forcibly cause the corrugation to have a wave in a small cycle, thereby preventing the recording sheet P from floating greatly.

An operation for ejecting the ink from the head face of the recording head 63 onto the recording sheet P while reciprocating the carriage 62 in the main scanning direction X and an operation for transporting the recording sheet P in a predetermined amount of delivery in a subscanning direction Y are repeated alternately so that the recording is carried out over the recording sheet P.

Moreover, the ink jet recording apparatus 50 has such a structure that a paper feeding cassette 70 for stacking, i.e., superposing a large number of recording sheets P like a layer can be attached. In a state where the paper feeding cassette 70 is attached, a paper feeder 78 is constituted by: a gate roller 73; a reverse roller 74; a hopper 75 and a high friction member 76 which are provided in the paper feeding cassette 70; and a paper feeding roller 71 and a pickup roller 72 which are provided in the ink jet recording apparatus 50. While the position of the paper feeding cassette 70 is placed on the rear side of the paper feeding roller 71 (the rightward side in FIG. 2) in the embodiment, it is a matter of course that the paper feeding cassette 70 may be positioned on the front side (the leftward side in FIG. 2). When the paper feeding cassette 70 is positioned on the front side of the paper feeding roller 71, the positions of the pickup roller 72 and the reverse roller 74 are also changed necessarily.

Figure 2:
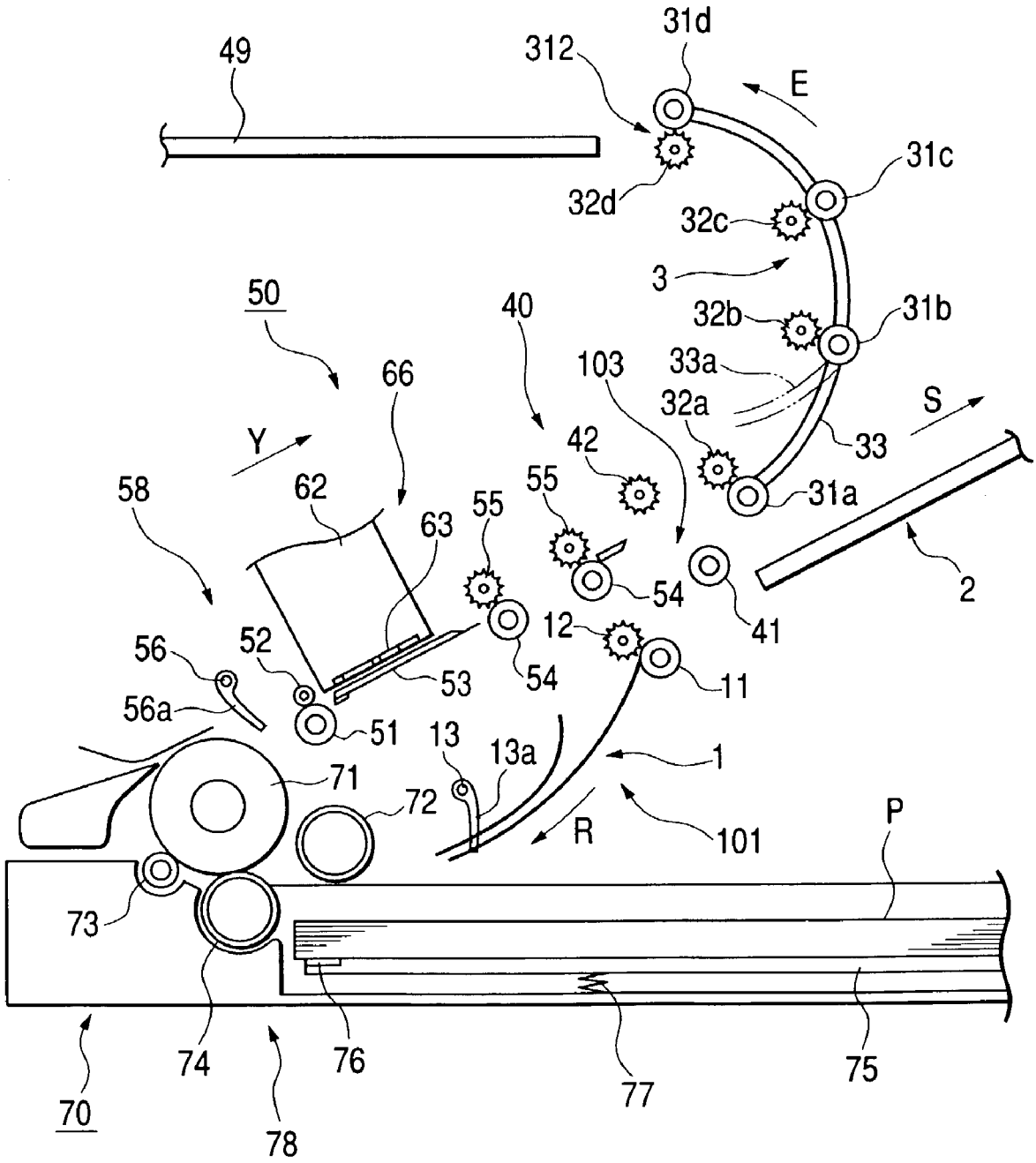
FIG. 2 is a side view of an essential part of the ink jet recording apparatus.

Furthermore, the ink jet recording apparatus 50 is provided with a feeding drive roller 51 and a feeding driven roller 52 as a paper transporter 58 for intermittently transporting the fed recording sheet P in the subscanning direction Y (FIG. 2). The rotation of the feeding drive roller 51 is controlled by a rotating power source and the recording sheet P is precisely delivered in the subscanning direction Y by the rotation of the feeding drive roller 51. A plurality of feeding driven rollers 52 are provided apart from each other in the main scanning direction X and are individually urged by the feeding drive roller 51, and are rotated by the delivery of the recording sheet P in contact therewith when the recording sheet P is delivered by the rotation of the feeding drive roller 51.

A paper detector 56 is provided on the upstream side in the subscanning direction Y of the feeding drive roller 51. In the embodiment, the paper detector 56 has a self-recovery habit into an attitude that a lever section 56*a* is supported pivotally in a protrusion state into the feeding path of the recording sheet P such that it can be pivoted in only the subscanning direction Y. When the tip of the lever section 56*a* is pushed by the recording sheet P, the lever section 56*a* is pivoted so that the recording sheet P is detected.

Furthermore, a paper discharger 40 for discharging the recording sheet P after the execution of the recording is provided on the downstream side of the recording head 63. For the paper discharger 40, a discharging drive roller 54 and a discharging driven roller 55 are provided in the vicinity of the downstream side of the recording head 63. The rotation of the discharging drive roller 54 is controlled by the rotation power source and the recording sheet P obtained after the execution of the recording is discharged in the subscanning direction Y by the rotation of the discharging drive roller 54.

The discharging driven roller 55 is a toothed roller having a plurality of teeth therearound, the tip of each of the teeth being sharp to come in point contact with the recording surface of the recording sheet P. The discharging driven rollers 55 are urged by smaller urging force than the urging force of the feeding driven roller 52 with the discharging drive rollers 54 respectively, and are rotated with the discharge of the recording sheet P in contact therewith when the recording sheet P is discharged by the rotation of the discharging drive roller 54. Then, the recording sheet P obtained after the execution of the recording is discharged to the downstream side in the subscanning direction Y by the discharging drive roller 54 and the discharging driven roller 55.

A curving path 3 to be the component of the paper discharger 40 is provided on the downstream side of the discharging drive roller 54 and the discharging driven roller 55. The curving path 3 is constituted to invert the recording sheet P while inwardly curving the recording surface obtained after the execution of the recording. The recording sheet P is then discharged to a discharging tray 49. More specifically, as shown in FIG. 2, the curving path 3 is constituted to feed the recording sheet P after the execution of the recording in a discharge direction E while curving the recording surface inwardly. The recording sheet P is then discharged almost horizontally from an outlet of the curving path 3 onto an almost horizontal discharging tray 49.

A discharge roller 312 is provided in the curving path 3 as shown in FIG. 2. In the embodiment, the discharge roller 312 has discharging drive rollers 31*a*, 31*b*, 31*c* and 31*d* to be driven and rotated by the transmission of rotating force from a driving source and discharging driven rollers 32*a*, 32*b*, 32*c* and 32*d* which can be rotated in an urging state with the discharging drive rollers 31*a*, 31*b*, 31*c* and 31*d* respectively. The recording sheet P is interposed between the discharging drive rollers 31*a*, 31*b*, 31*c* and 31*d* and the discharging driven rollers 32*a*, 32*b*, 32*c* and 32*d* to be transported in the discharging direction E along the curving path 3 by the rotating operation of the discharging drive rollers 31*a*, 31*b*, 31*c* and 31*d*. The discharge roller 312 is provided to discharge the recording sheet P in such a state that the discharging driven rollers 32*a*, 32*b*, 32*c* and 32*d* come in contact with the recording surface of the recording sheet P.

Furthermore, the ink jet recording apparatus 50 comprises an inversive paper feeder 101 for performing recording on both sides of the recording sheet P. The inversive paper feeder 101 feeds the recording sheet P obtained after the execution of the recording onto one surface toward the paper feeding roller 71 of the paper feeder 78 in a reverse direction R. The trailing end of the recording sheet P obtained after the execution of the recording onto one surface becomes a leading end when the recording sheet P is transported through an inversive feeding path 1 which is different from the feeding path in which the execution of the recording onto the one surface of the recording sheet P is performed. The recording sheet P is again transported to the recording section 66 through the paper transporter 58 by the paper feeding roller 71 so that the back face of the recording sheet P is to be the recording surface.

Moreover, the inversive paper feeder 101 comprises an escape tray 2 for temporarily shunting the recording sheet P after the execution of the recording of the one surface. Furthermore, the inversive paper feeder 101 comprises a leading end guide section 103 for guiding the leading end of the recording sheet P obtained after the execution of the recording in an escaping direction S while transporting the recording sheet P in the subscanning direction Y, thereby shunting the recording sheet P in the escape tray 2.

The leading end guide section 103 is constituted such that a rocking section 33 of the curving path 3 is rocked and retracted from the curving path 3 to the position 33*a* shown in a dashed line in FIG. 2, thereby shunting the recording sheet P obtained after the execution of the recording of the one surface to the escape tray 2. Since a part of the curving path 3 also serves as the leading end guide section 103, it is not necessary to provide the leading end guide section 103 as a separate member.

Furthermore, the inversive paper feeder 101 comprises a two-way feeding drive roller 41 and a two-way feeding driven roller 42 which lead, to the inversive feeding path 1, the trailing end of the recording sheet P shunt in the escape tray 2 is delivered to the inversive feeding path 1 as a new leading end. Furthermore, the two-way feeding driven roller 42 is attached to a rocking arm (not shown) and is constituted to be releasable from the two-way feeding drive roller 41. The two-way feeding driven roller 42 is a toothed roller having a plurality of teeth therearound, the tip of each of the teeth being sharp to come in point contact with the recording surface of the recording sheet P.

Furthermore, the inversive paper feeder 101 comprises an inversive feeding driving roller 11 and an inversive feeding driven roller 12 on the inlet side of the inversive feeding path 1. The inversive feeding driving roller 11 rotates in contact with a back surface of the recording sheet P delivered to the inversive feeding path 1, and the inversive feeding driven roller 12 is rotated in contact with the recorded surface. The inversive feeding driving roller 11 and the inversive feeding driven roller 12 sandwich the recording sheet P to reversely feed toward the paper feeding roller 71 of the paper feeder 78 by the rotating operation of the inversive feeding driving roller 11.

Moreover, the inversive paper feeder 101 comprises a paper detector 13 in the inversive feeding path 1. In the same manner as the paper detector 56, the paper detector 13 has a self-recovery habit into an attitude that a lever section 13*a* supported pivotally is protruded into the inversive feeding path 1 so as to be rotated in only the inversive feeding direction. When the tip of the lever section 13*a* is pushed by the recording sheet P, the lever section 13*a* is rotated so that the recording sheet P is detected.

Figure 3:
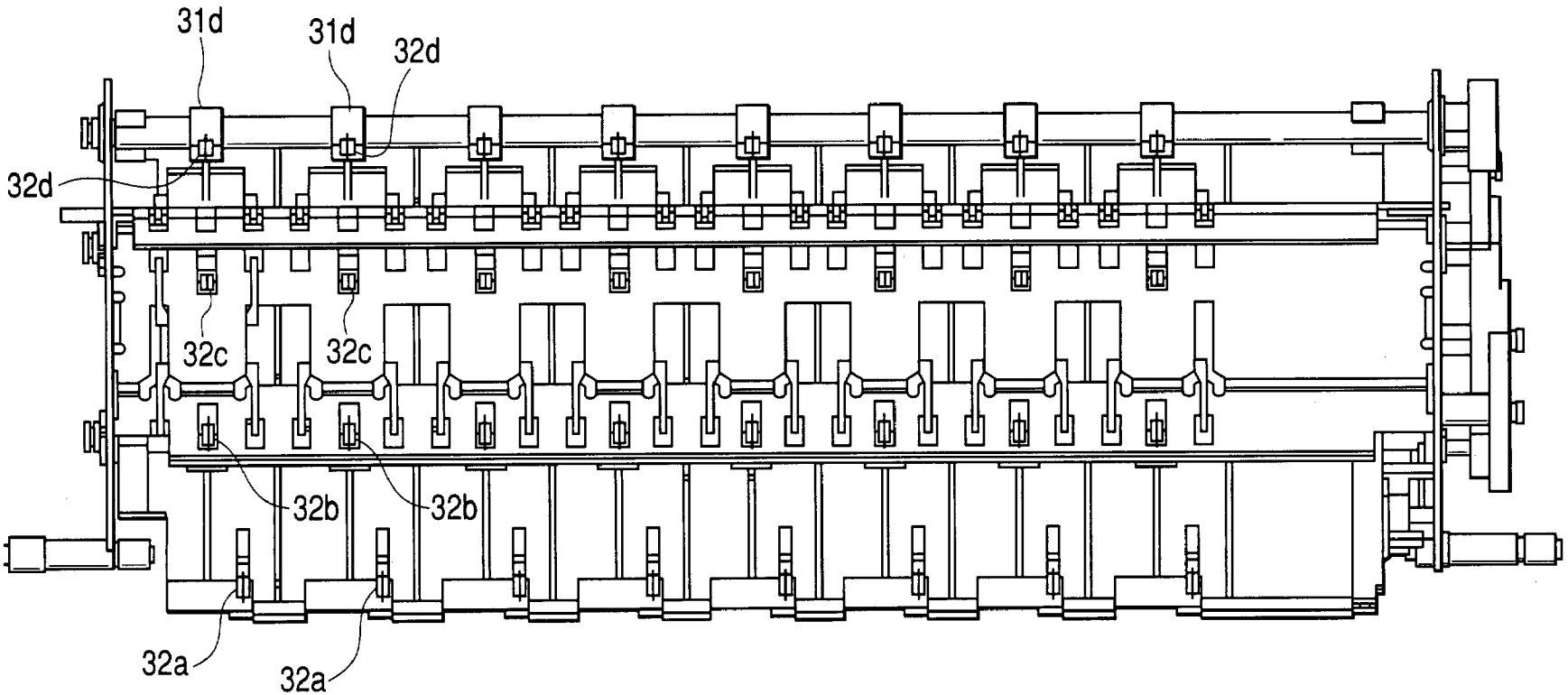
FIG. 3 is a front view of a curving path of the ink jet recording apparatus.

Next, the curving path 3 will be described. FIG. 3 is a front view showing the curving path 3.

In the same manner as the discharging drive roller 54, the rotation of the discharging drive rollers 31*a* to 31*d* are controlled by a rotation power source so that the recording sheet P in the curving path 3 is discharged in the discharge direction E. The discharging driven rollers 32*a* to 32*d* are toothed rollers having a plurality of teeth therearound, the tip of each of the teeth being sharp to come in point contact with the recording surface of the recording sheet P in the same manner as the discharging driven roller 55. The discharging driven rollers 32*a* to 32*d* respectively are urged toward the discharging drive rollers 31*a* to 31*d* with a smaller urging force than the urging force of the feeding driven roller 52. The discharging driven rollers 32*a* to 32*d* are rotated with the discharge of the recording sheet P in contact therewith when the recording sheet P is discharged by the rotation of the discharging drive rollers 31*a* to 31*d* in the discharge direction E.

Accordingly, it is possible to reduce a possibility that the discharging drive rollers 31*a* to 31*d* might slip from a surface coming in contact with the recording sheet P, resulting in the unstable delivery state of the recording sheet P.

Subsequently, description will be given to the step of feeding the recording sheet P by the paper feeder 78, executing the recording over the recording surface and discharging the recording sheet P when executing the recording over the recording sheet P in the ink jet recording apparatus 50 according to the embodiment.

Figure 4:
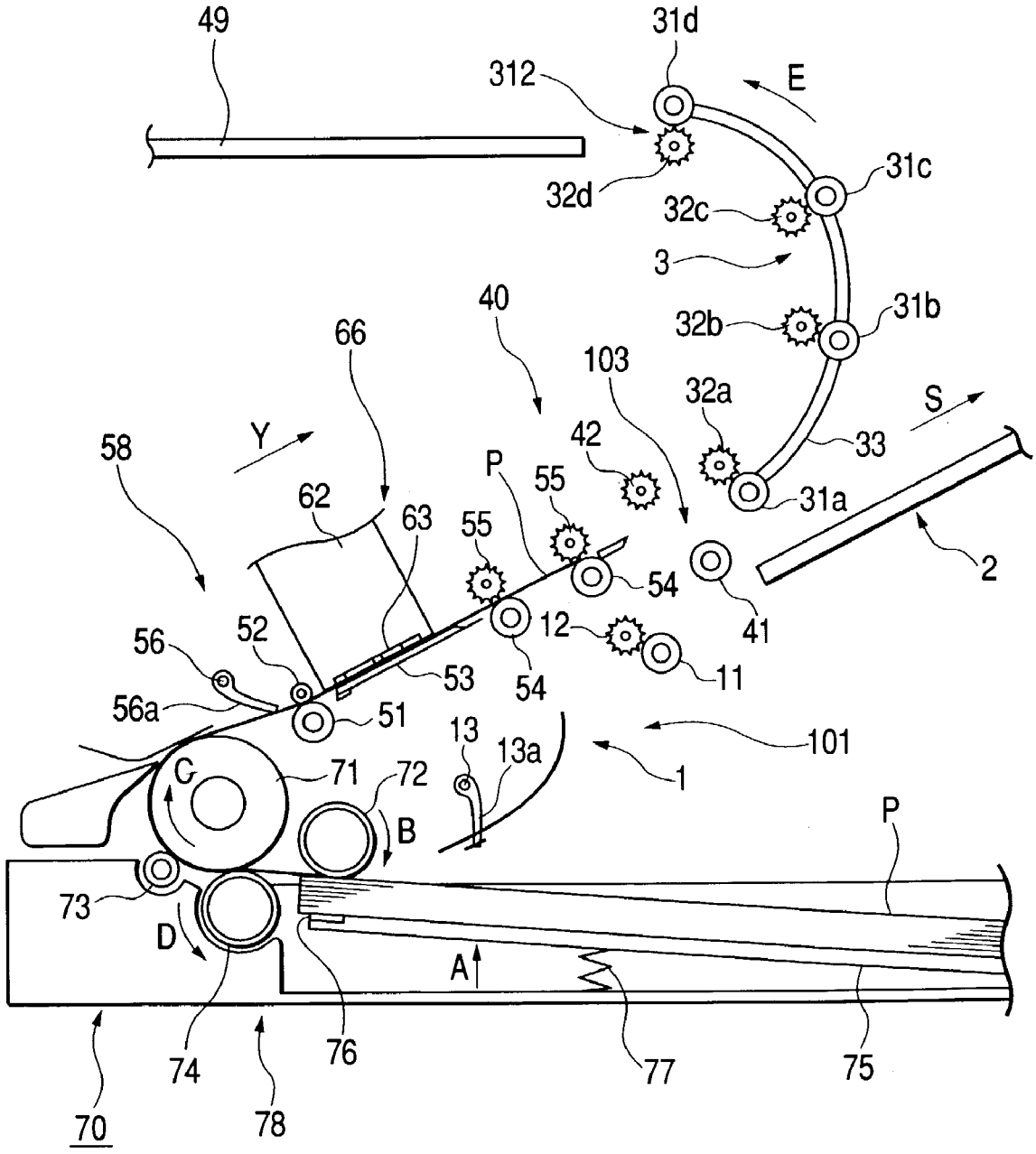
FIG. 4 is a side view of the essential part of the ink jet recording apparatus, illustrating a state where a recording paper is fed and recording is executed over a recoding surface.

As shown in FIG. 4, a hopper 77 is lifted in a direction of an arrow of A. Consequently, the uppermost one of the recording sheets P stacked in the paper feeding cassette 70 is pushed against the pickup roller 72. Then, the pickup roller 72 is rotated in a rotating direction shown in an arrow of B so that the leading end of the recording sheet P pushed against the pickup roller 72 reaches a nip point of the paper feeding roller 71 and the reverse roller 74 (a contact point of the rollers).

Subsequently, the paper feeding roller 71 is rotated in a rotating direction shown in an arrow of C so that the leading end of the recording sheet P reaches a nip point of the feeding drive roller 51 and the feeding driven roller 52. A rotation shaft of the reverse roller 74 is rotated in a reverse direction to the paper feeding direction, that is, a direction in which the recording sheet P is returned into the paper feeding cassette 70. Then, the reverse roller 74 is rotatably brought into contact with the rotation shaft with a constant rotating resistance. In a state where only one recording sheet P is interposed between the paper feeding roller 71 and the reverse roller 74, the reverse roller 74 is rotated with the recording sheet P fed by the rotating operation of the paper feeding roller 71 (a rotating direction shown in an arrow of D in FIG. 4).

On the other hand, in a state where a plurality of recording sheets P are interposed between the paper feeding roller 71 and the reverse roller 74, the rotating resistance of the reverse roller 74 is greater than a frictional resistance between the recording sheets P. Therefore, the reverse roller 74 is rotated in such a direction as to return the recording sheet P into the paper feeding cassette 70 by the rotating operation of the rotating shaft of the reverse roller 74, so that the recording sheet P coming in contact with the reverse roller 74 is returned into the paper feeding cassette 70. Thus, the reverse roller 74 separates the superposed recording sheets P at the nip point with the paper feeding roller 71, and serves to prevent the plural recording sheets P from being fed by the rotation of the paper feeding roller 71.

The high friction member 76 provided in the vicinity of the end of the hopper 75 prevents the stacked recording sheets P from being moved together in the paper feeding direction when the uppermost one of the recording sheets P stacked in the hopper 75 is to be fed to the paper feeding roller 71 by the pickup roller 72, resulting in a reduction in a possibility that the superposed recording sheet P might be fed. A coiled spring 77 is provided with a construction between the hopper 75 and the bottom portion of the paper feeding cassette 70 so as to lift the hopper 75. The gate roller 73 is rotated while pushing the recording sheet P against the paper feeding roller 71.

Subsequently, the recording sheet P having the leading end thereof reached the nip point of the feeding drive roller 51 and the feeding driven roller 52 by the rotation of the paper feeding roller 71 is intermittently delivered in a predetermined amount of delivery in the subscanning direction Y by the rotating operation of the feeding drive roller 51. Incidentally, ink is ejected onto the recording surface, from the recording head 63 mounted on the carriage 62 to be reciprocated in the main scanning direction X so that the recording is executed over the recording surface. Then, the recording sheet P receives feeding force by the rotating operation of the discharging drive roller 54, and successively, is delivered in the subscanning direction Y in such a state that the recording sheet P is interposed between the discharging drive roller 54 and the discharging driven roller 55.

Figure 5:
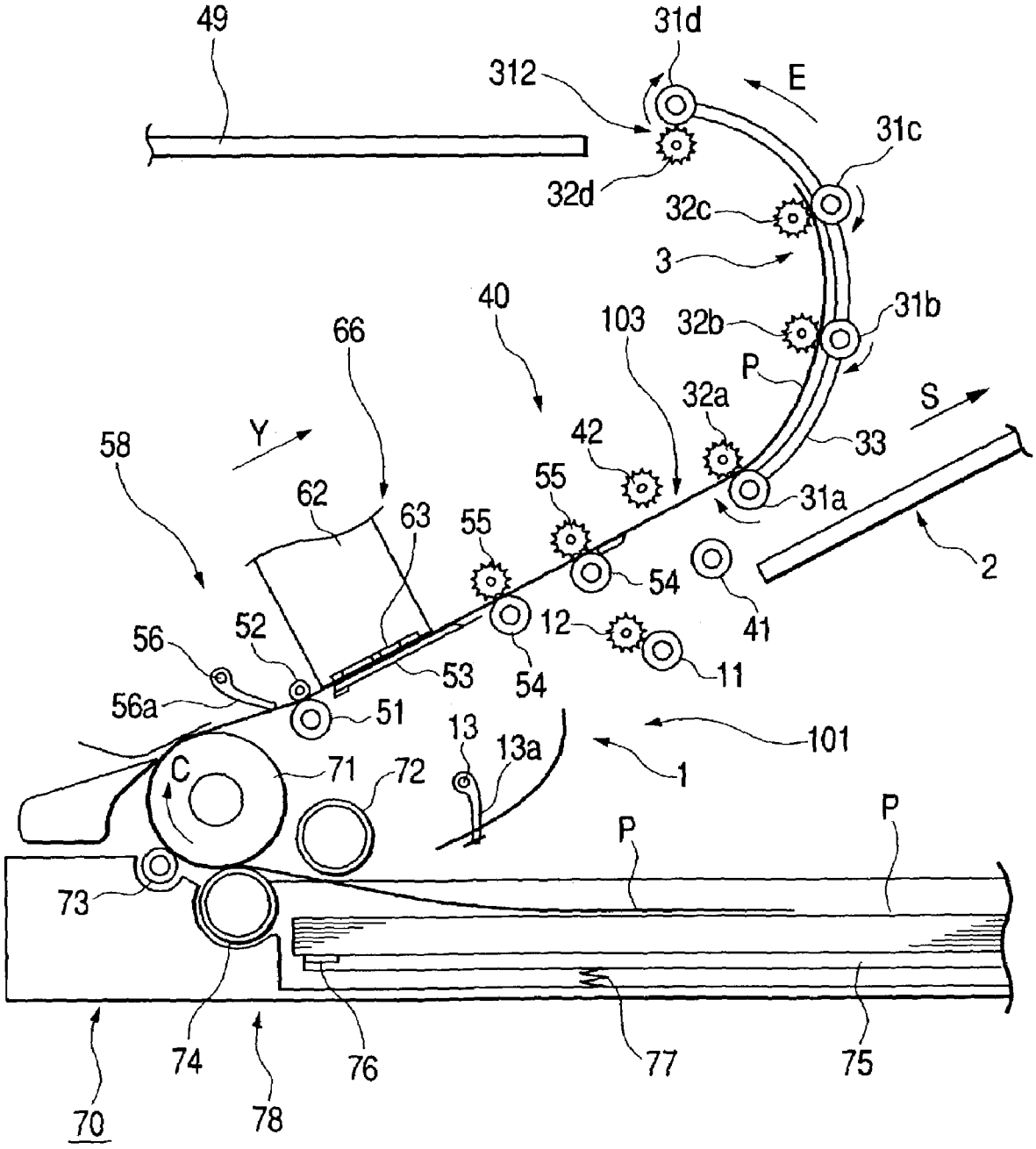
FIG. 5 is a side view of the essential part of the ink jet recording apparatus according to the invention, illustrating a state where the recording paper having the recording surface subjected to the recording is delivered to a discharging path.

Next, as shown in FIG. 5, the recording sheet P subjected to the recording is transported along the curving path 3 by the discharging drive rollers 31*a* to 31*d* and the discharging driven rollers 32*a* to 32*d* while the recorded surface is curved inwardly.

The curving path 3 inwardly curves the recording surface of the recording sheet P obtained after the execution of the recording, and discharges the recording sheet P to the discharging tray 49. In such a configuration, the recording sheet P which is moistened by the ink and is then being dried, that is, the recording sheet P which is being corrugated is curved in the curving path 3 so that corrective force in a direction orthogonal to the curving direction (right and left direction in FIG. 3) can be caused to act on the recording sheet P. In other words, the recording sheet P is curved in the feeding direction such that the recording surface is set to the inside. Consequently, the corrective force in the main scanning direction X acts on the recording sheet P. Accordingly, it is possible to correct and reduce the corrugation of the recording sheet P which is generated by the cockling phenomenon while passing through the curving path 3.

In some cases, moreover, the recording sheet P is curled cylindrically due to a moisture caused by the water content of the ink and a dryness. According to the embodiment, the recording sheet P is caused to pass through the inversion curving path 3 and is thus curved in a direction orthogonal to a curling direction. Consequently, it is possible to automatically and easily mend the curl generated on the recording sheet P without bothering a user. In addition, it is also possible to rarely damage the recording sheet P and to prevent the quality of a printed matter from being deteriorated in the mending.

Moreover, it is possible to employ the structure of an apparatus in which the recording sheet P is curved so that the recording sheet P fed from a front side is discharged to the front side again after the execution of the recording. Consequently, a user can use the apparatus more easily. Furthermore, the recording surface of the recording sheet P is inverted inwardly and is thus discharged. Therefore, the recording surface obtained after the execution of the recording faces downward. When the recording is continuously executed over a plurality of recording sheets P, consequently, the recording sheets P obtained after the execution of the recording which are stacked in the discharging tray 49 are superposed in order of the execution of the recording. Accordingly, also in the case where a document having a plurality of pages is printed, for example, the pages are stacked in the discharging tray 49 in order. Therefore, time and labor for rearranging the pages are not taken.

Furthermore, the force for correcting the corrugation in the main scanning direction X which acts on a part of the recording sheet P in the curving path 3 is also applied to the corrugated portion of the recording sheet P which still situates the recording section 66. Accordingly, if the curvature of the curving path 3 is too large, the corrective force is excessively increased. Consequently, there is a possibility that the recording sheet P in the recording section 66 might float. For this reason, there is a possibility that a part of the recording sheet P in the recording section 66 might float to come in contact with the recording head 63.

In the embodiment, the feeding path in the recording section 66 of the ink jet recording apparatus 50 is inclined such that the downstream side in the subscanning direction Y is directed upward as shown in the drawings. In the embodiment, an inclination angle is set as 60 degrees. Consequently, it is possible to curve and invert the recording sheet P in the curving path 3 with a smaller curvature than a case where the recording sheet P is curved and inverted from the feeding path extending horizontally. Accordingly, it is possible to reduce a possibility that the recording sheet P in the recording section 66 might float by the corrective force of the curving path 3.

In the ink jet recording apparatus 50, the ribs 53*a* formed in the platen 53 are not provided on the surface with which the vicinity of both side ends of the recording sheet P slidably comes in contact. Consequently, the height of both side ends of the recording sheet P in the recording section 66 is accordingly reduced. Thus, it is possible to reduce the float in the vicinity of both side ends of the recording sheet P by the corrugation generated in the recording sheet P due to the cockling phenomenon. The recording sheet P is apt to float at both side ends thereof by the force for correcting the corrugation in the main scanning direction X which acts on the recording sheet P in the curving path 3. Accordingly, it is possible to reduce a possibility that both side ends of the recording sheet P floated by the corrective force of the curving path 3 might come in contact with the recording head 63.

Figure 6:
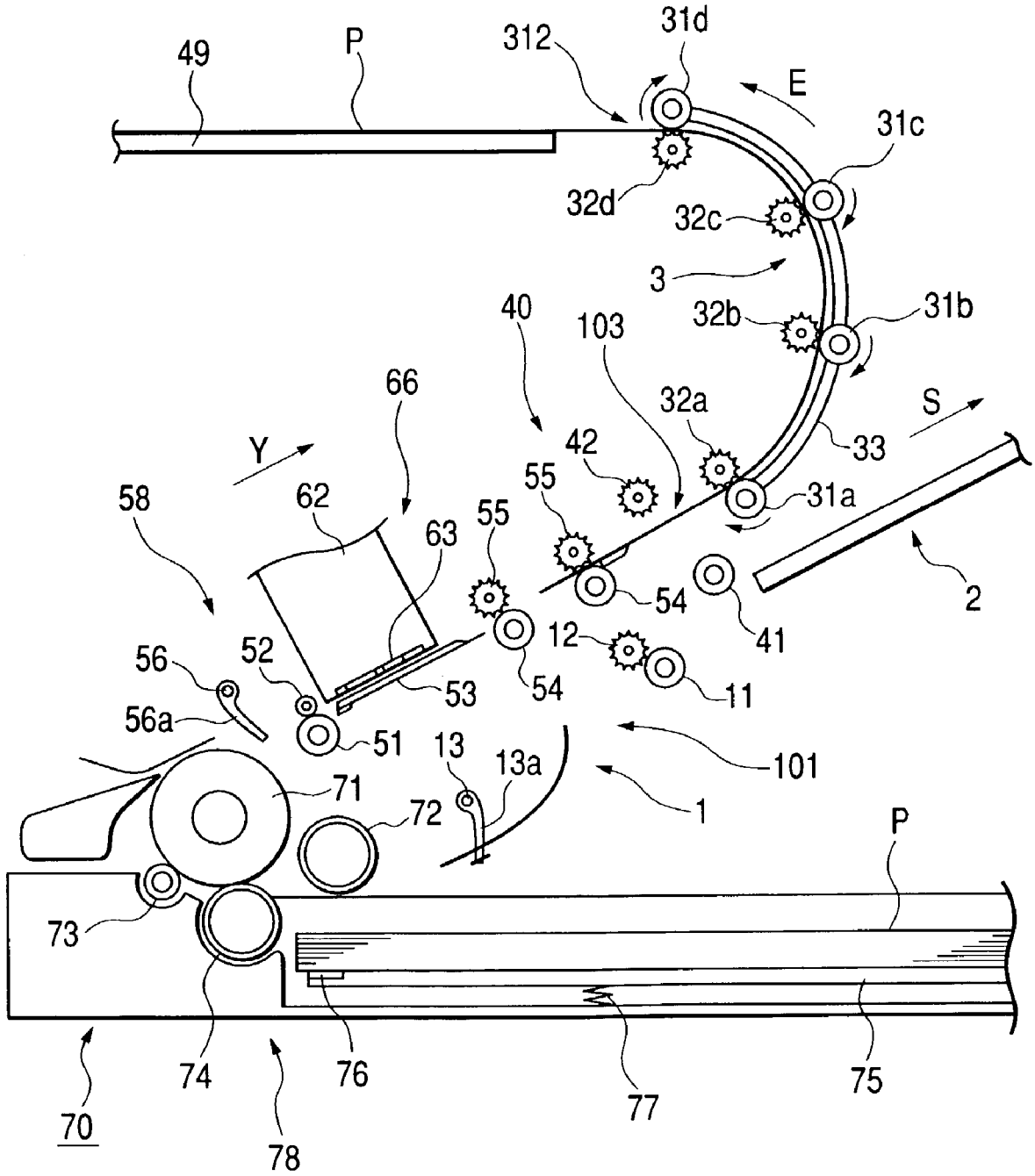
FIG. 6 is a side view of the essential part of the ink jet recording apparatus according to the invention, illustrating a state where the recording paper having the recording surface subjected to the recording is discharged through the curving path.

As shown in FIG. 6, the recording sheet P having the recording surface subjected to the recording is then discharged to the discharging tray 49 in such a state that the recorded surface is curved inwardly in the curving path 3 by the discharging drive rollers 31*a* to 31*d* and the discharging driven rollers 32*a* to 32*d*.

Figure 7A:
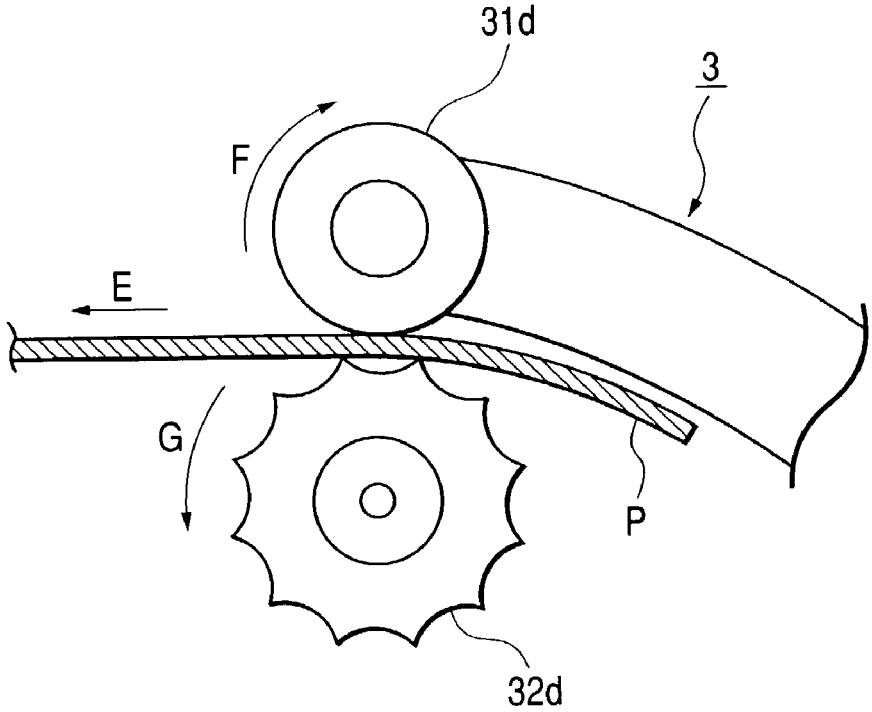
FIG. 7A is an enlarged view of the vicinity of an outlet of the curving path, showing a state immediately before the discharge of the recording paper is discharged.

As shown in FIG. 7A, the recording sheet P obtained after the execution of the recording which is discharged through the curving path 3 is discharged from the curving path 3 to the discharging tray 49 by the discharging drive roller 31*d* which is provided on the most downstream side in the discharge direction E of the curving path 3 and is rotated in a rotating direction shown in an arrow of F, and the discharging driven roller 32*d* to be rotated with the discharge of the recording sheet P (in a rotating direction shown in an arrow of G) in an urged state against the discharging drive roller 31*d*.

Figure 7B:
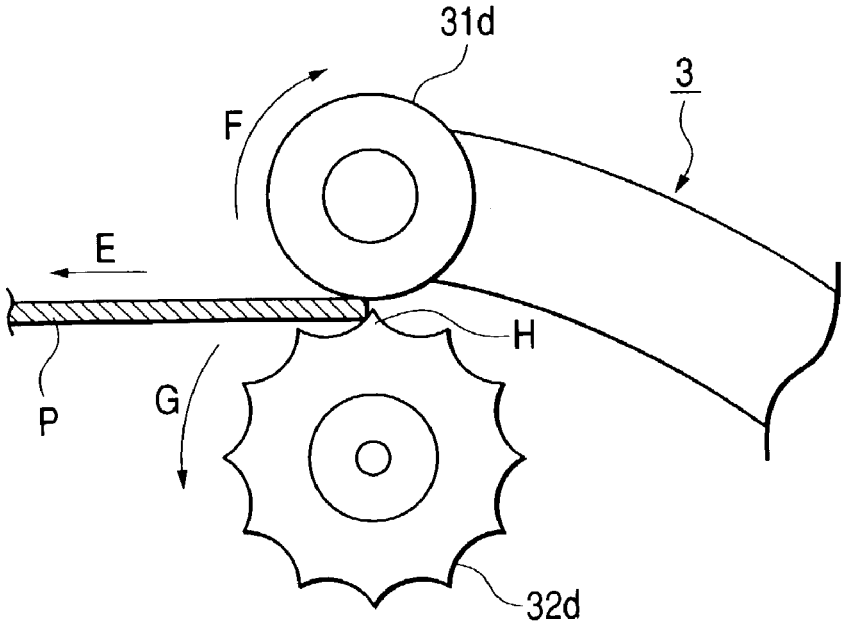
FIG. 7B is an enlarged view of the vicinity of the outlet of the curving path, showing a state where the recording paper is pushed by a tooth of a discharging driven roller.

In that case, as shown in FIG. 7B, the trailing end of the recording sheet P is caught on a tooth H (one of a large number of teeth formed on the outer periphery) of the discharging driven roller 32*d*. Consequently, the recording sheet P is discharged from the curving path 3 such that the trailing end thereof is pushed by the tooth H. Accordingly, it is possible to reliably discharge the recording sheet P toward the discharging tray 49 without stopping at the outlet of the curving path 3.

It is apparent that the invention is not restricted to the embodiment but various modifications can be made within the invention according to the appended claims and are also included within the scope of the invention.

What is claimed is:

1. An ink jet recording apparatus, comprising:

a recording section, in which a recording head is reciprocated in a first direction while ejecting ink therefrom onto a recording medium;

a transporter, including a plurality of first rollers operable to transport the recording medium toward the recording section along a first transporting path in a second direction perpendicular to the first direction;

a discharger, including a second transporting path in which a transporting direction of the recording medium is inversed such that a first face of the recording medium on which recording has been performed faces inward, the discharger including a plurality of second rollers provided along the second transporting path and adapted to come in contact with the first face of the recording medium transported from the recording section, and a third transporting path, adapted to receive the recording medium transported from the recording section, wherein the first transporting path defined in the recording section is upwardly inclined toward the discharger, wherein each of the second rollers is a toothed roller an outer periphery of which is formed with teeth, wherein the first rollers are urged toward the first transporting path with a first force, and the second rollers are urged toward the second transporting path with a second force weaker than the first force, wherein a part of the second transporting path is movable between a first position and a second position, wherein the recording medium which has passed the recording section is guided into the second transporting path when the part of the second transporting path is placed in the first position, and wherein the recording medium which has passed the recording section is guided into the third transporting path when the part of the second transporting path is placed in the second position.

2. The ink jet recording apparatus as set forth in claim 1, wherein:

the plurality of second rollers include at least one driven roller disposed in the second transporting path that rotates in conjunction with a drive roller such that the recording medium is held and transported therebetween.

3. The ink jet recording apparatus as set forth in claim 2, wherein the driven roller arranged closest to a termination end of the second transporting path, has the teeth formed on an outer periphery thereof.

4. The ink jet recording apparatus as set forth in claim 2, wherein the first transporting path points toward a beginning portion of the second transporting path.

5. The ink jet recording apparatus as set forth in claim 4, wherein an inclined angle of the first transporting path in the recording section is within a range of 30 degrees to 75 degrees.

6. The ink jet recording apparatus as set forth in claim 2, wherein the driven roller closest to a termination end of the second transporting path is disposed at an utmost end of the second transporting path.

7. The ink jet recording apparatus as set forth in claim 1, wherein an outlet of the second transporting path is configured such that the recording medium is almost horizontally discharged therefrom.

8. The ink jet recording apparatus as set forth in claim 1, wherein:

the recording section includes a platen defining a spacing between a head face of the recording head and the first surface of the recording medium; and a plurality of ribs are formed on the platen so as to extend in the second direction.

9. The ink jet recording apparatus as set forth in claim 8, wherein the ribs are not formed at portions of the platen where side end portions of the recording medium are brought into contact.

10. The ink jet recording apparatus as set forth in claim 1, further comprising:

a fourth transporting path; and third rollers, a relative position of which is variable between a contact state such that the third rollers come in contact with each other and a separate state such that the third rollers are away from each other, wherein the third rollers are in the separate state when the part of the second transporting path is placed in the first position, and wherein the third rollers are in the contact state when the part of the second transporting path is placed in the second position, and are operable to transport the recording medium received in the third transporting path to the fourth transporting path.

11. An ink jet recording apparatus, comprising:

a recording section, in which a recording head is reciprocated in a first direction while ejecting ink therefrom onto a recording medium;

means for transporting the recording medium toward the recording section along a first transporting path in a second direction perpendicular to the first direction, the transporting means including a plurality of first rollers;

means for discharging the recording medium along a second transporting path such that the recording medium is inversed and a first face of the recording medium on which recording has been performed faces inward, the discharging means including a plurality of second rollers provided along the second transporting path and adapted to come in contact with the first face of the recording medium transported from the recording section; and a third transporting path, adapted to receive the recording medium transported from the recording section, wherein the first transporting path defined in the recording section is upwardly inclined toward the discharger, wherein each of the second rollers is a toothed roller an outer periphery of which is formed with teeth, wherein the first rollers are urged toward the first transporting path with a first force, and the second rollers are urged toward the second transporting path with a second force weaker than the first force, wherein a part of the second transporting path is movable between a first position and a second position, wherein the recording medium which has passed the recording section is guided into the second transporting path when the part of the second transporting path is placed in the first position, and wherein the recording medium which has passed the recording section is guided into the third transporting path when the part of the second transporting path is placed in the second position.

12. The ink jet recording apparatus as set forth in claim 11, wherein the first transporting path points toward a beginning portion of the second transporting path.

13. The ink jet recording apparatus as set forth in claim 11, further comprising:

a fourth transporting path; and third rollers, a relative position of which is variable between a contact state such that the third rollers come in contact with each other and a separate state such that the third rollers are away from each other, wherein the third rollers are in the separate state when the part of the second transporting path is placed in the first position and wherein the third rollers are in the contact state when the part of the second transporting path is placed in the second position, and are operable to transport the recording medium received in the third transporting path to the fourth transporting path.

14. An ink jet recording apparatus, comprising:

a recording head, operable to eject ink onto a recording medium;

a recording section, including the recording head;

a first transporting path;

a transporter, including a plurality of first rollers operable to transport the recording medium toward the recording section along the first transporting path in a second direction perpendicular to a first direction;

a discharger, including a second transporting path in which a transporting direction of the recording medium is inversed such that a first face of the recording medium faces inward, the discharger including a plurality of second rollers provided along the second transporting path and adapted to come in contact with the first face of the recording medium transported from the recording section;

a third transporting path, adapted to receive the recording medium transported from the recording section;

a fourth transporting path; and third rollers, a relative position of which is variable between a contact state such that the third rollers come in contact with each other and a separate state such that the third rollers are away from each other, wherein a part of the second transporting path is movable between a first position and a second position, wherein the recording medium which has passed the recording section is guided into the second transporting path when the part of the second transporting path is placed in the first position, wherein the recording medium which has passed the recording section is guided into the third transporting path when the part of the second transporting path is placed in the second position, wherein the third rollers are in the separate state when the part of the second transporting path is placed in the first position, and wherein the third rollers are in the contact state when the part of the second transporting path is placed in the second position, and are operable to transport the recording medium received in the third transporting path to the fourth transporting path.

* * * * *